US008925615B2

(12) United States Patent
Lin

(10) Patent No.: US 8,925,615 B2
(45) Date of Patent: Jan. 6, 2015

(54) CORD GUIDING DEVICE FOR A WINDOW BLIND

(71) Applicant: Ke-Min Lin, Chiayi (TW)

(72) Inventor: Ke-Min Lin, Chiayi (TW)

( * ) Notice: Subject to any disclaimer, the term of this patent is extended or adjusted under 35 U.S.C. 154(b) by 0 days.

(21) Appl. No.: 13/899,206

(22) Filed: May 21, 2013

(65) Prior Publication Data

US 2014/0217142 A1 Aug. 7, 2014

(30) Foreign Application Priority Data

Feb. 7, 2013 (TW) ..... 102202787 U

(51) Int. Cl.
*E06B 9/30* (2006.01)
*A47H 3/10* (2006.01)
*E06B 9/322* (2006.01)

(52) U.S. Cl.
CPC *A47H 3/10* (2013.01); *E06B 9/322* (2013.01); *E06B 2009/3225* (2013.01)
USPC ..... 160/170; 160/173 R

(58) Field of Classification Search
USPC ..... 160/170, 171, 173 R, 84.04, 84.05, 160/168.1 R, 176.1 R, 177 R, 178.1 R
See application file for complete search history.

(56) References Cited

U.S. PATENT DOCUMENTS

| | | | | |
|---|---|---|---|---|
| 7,025,107 | B2 * | 4/2006 | Ciuca | 160/170 |
| 7,168,476 | B2 * | 1/2007 | Chen | 160/170 |
| 7,258,297 | B2 * | 8/2007 | Liu | 242/398 |
| 7,281,563 | B2 * | 10/2007 | Wu | 160/170 |
| 7,343,957 | B2 * | 3/2008 | Lin | 160/168.1 R |
| 7,624,785 | B2 * | 12/2009 | Yu et al. | 160/171 |
| 7,717,154 | B2 * | 5/2010 | Cheng | 160/170 |
| 7,832,453 | B2 * | 11/2010 | Lin | 160/168.1 R |
| 7,866,367 | B2 * | 1/2011 | Liang et al. | 160/173 R |
| 7,886,803 | B2 * | 2/2011 | Anderson et al. | 160/170 |
| 7,913,738 | B2 * | 3/2011 | Fraser et al. | 160/115 |
| 7,984,745 | B2 * | 7/2011 | Wen et al. | 160/170 |
| 8,485,242 | B2 * | 7/2013 | Fraser et al. | 160/115 |
| 8,613,304 | B2 * | 12/2013 | Kraler et al. | 160/177 R |
| 8,662,135 | B2 * | 3/2014 | Lin | 160/170 |

(Continued)

FOREIGN PATENT DOCUMENTS

| | | |
|---|---|---|
| DE | 20101006 | 3/2001 |
| EP | 1571289 | 9/2005 |
| EP | 1840319 | 10/2007 |

OTHER PUBLICATIONS

Search Report issued on Sep. 12, 2014 by the EPO in counterpart European Application No. 13170427.2.

*Primary Examiner* — Katherine Mitchell
*Assistant Examiner* — Johnnie A Shablack
(74) *Attorney, Agent, or Firm* — Merek, Blackmon & Voorhees, LLC

(57) ABSTRACT

A cord guiding device for a window blind includes a wheel holder, a guiding wheel and a cord-blocking unit. The guiding wheel is rotatably mounted on the wheel holder, and includes two protruding flanges that are spaced apart from each other, and has a wheel surface that is defined and disposed between the protruding flanges and that is adapted for a cord of the window blind to wind thereon. The cord-blocking unit is mounted on the wheel holder, and has a blocking surface that faces and is disposed proximate to the wheel surface of the guiding wheel for preventing the cord from slipping off the wheel surface and out from the protruding flanges.

2 Claims, 12 Drawing Sheets

(56) References Cited

U.S. PATENT DOCUMENTS

| | | | | |
|---|---|---|---|---|
| 2006/0065373 | A1 | 3/2006 | Chen | |
| 2007/0056692 | A1* | 3/2007 | Nien et al. | 160/168.1 R |
| 2007/0084569 | A1* | 4/2007 | Lin | 160/173 R |
| 2007/0227677 | A1* | 10/2007 | Yu et al. | 160/170 |
| 2007/0251653 | A1* | 11/2007 | Liu | 160/177 R |
| 2007/0267154 | A1* | 11/2007 | Gramsch | 160/173 R |
| 2007/0272364 | A1* | 11/2007 | Liang | 160/84.05 |
| 2008/0093035 | A1* | 4/2008 | Hsu et al. | 160/176.1 R |
| 2008/0264576 | A1* | 10/2008 | Cheng | 160/168.1 V |
| 2008/0289774 | A1* | 11/2008 | Ying | 160/178.1 R |
| 2009/0159219 | A1* | 6/2009 | Wen et al. | 160/170 |
| 2012/0227913 | A1* | 9/2012 | Chou | 160/176.1 R |
| 2013/0340952 | A1* | 12/2013 | Kao | 160/170 |
| 2014/0083631 | A1* | 3/2014 | Huang | 160/170 |

* cited by examiner

CORD GUIDING DEVICE FOR A WINDOW BLIND

CROSS-REFERENCE TO RELATED APPLICATION

This application claims priority of Taiwanese Patent Application No. 102202787, filed on Feb. 7, 2013.

BACKGROUND OF THE INVENTION

1. Field of the Invention

The invention relates to a cord guiding device, more particularly to a cord guiding device for guiding cords of a window blind.

2. Description of the Related Art

Shown in FIG. 1 is a conventional window blind 1 including a securing seat 11, a blind 12 that hangs below the securing seat 11 and that folds upwardly and unfolds downwardly, a cord roller device 13 disposed at the center top portion of the securing seat 11, two cord guiding devices 14 disposed on the securing seat 11 at respective opposite sides of the cord roller device 13, and a cord 15 that is movable by the cord roller device 13 and that controls the folding and unfolding of the blind 12. Each of the cord guiding devices 14 includes a wheel holder 141 that is mounted on the securing seat 11 and that is formed with a positioning hole 140, and a guiding wheel 142 that is mounted to the wheel holder 141. The wheel holder 142 has a plurality of protruding flanges 143 projecting radially, and two wheel surfaces 144, each being disposed between a corresponding adjacent pair of the protruding flanges 143. After being wound on the wheel surfaces 144 of the guiding wheels 142, the cord 15 passes through the positioning holes 140 in the wheel holders 141 and are then attached to the blind 12 so as to control movement of the blind 12.

If an uneven force is applied to the conventional window blind 1 during the process of folding or unfolding of the blind 12, jamming of the cord 15 between the guiding wheel(s) 142 and the wheel holder(s) 141 is likely to occur when the cord 15 becomes loosely wound on the wheel surface(s) 144 of the guiding wheel(s) 142 and slips out of the protruding flange(s) 143.

SUMMARY OF THE INVENTION

Therefore, the object of the present invention is to provide a cord guiding device that can eliminate the aforesaid drawbacks of the prior art.

According to the present invention, there is provided a cord guiding device for a window blind. The cord guiding device includes a wheel holder, at least one guiding wheel and a cord-blocking unit. The guiding wheel is rotatably mounted on the wheel holder, includes two protruding flanges that are spaced apart from each other, and has a wheel surface that is defined and disposed between the protruding flanges and that is adapted for at least one cord of the window blind to wind thereon. The cord-blocking unit is mounted on the wheel holder, and has at least one blocking surface that faces and is disposed proximate to the wheel surface of the guiding wheel for preventing the cord from slipping off the wheel surface and out from the protruding flanges of the guiding wheel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
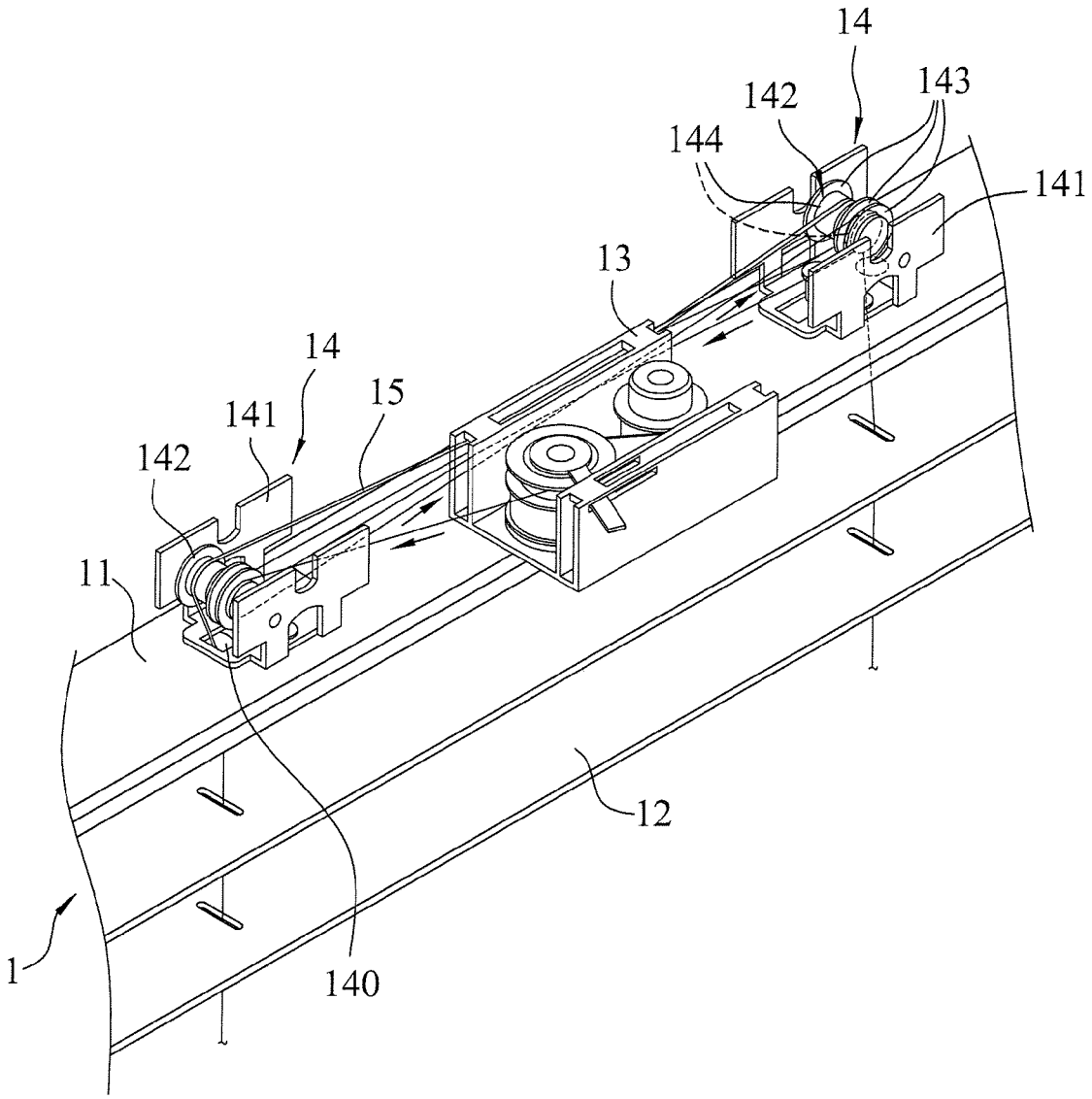
FIG.1 PRIOR ART
FIG. 1 is a fragmentary perspective view of a conventional window blind.

Before the present invention is described in greater detail, it should be noted that like elements are denoted by the same reference numerals throughout the disclosure.

Figure 2:
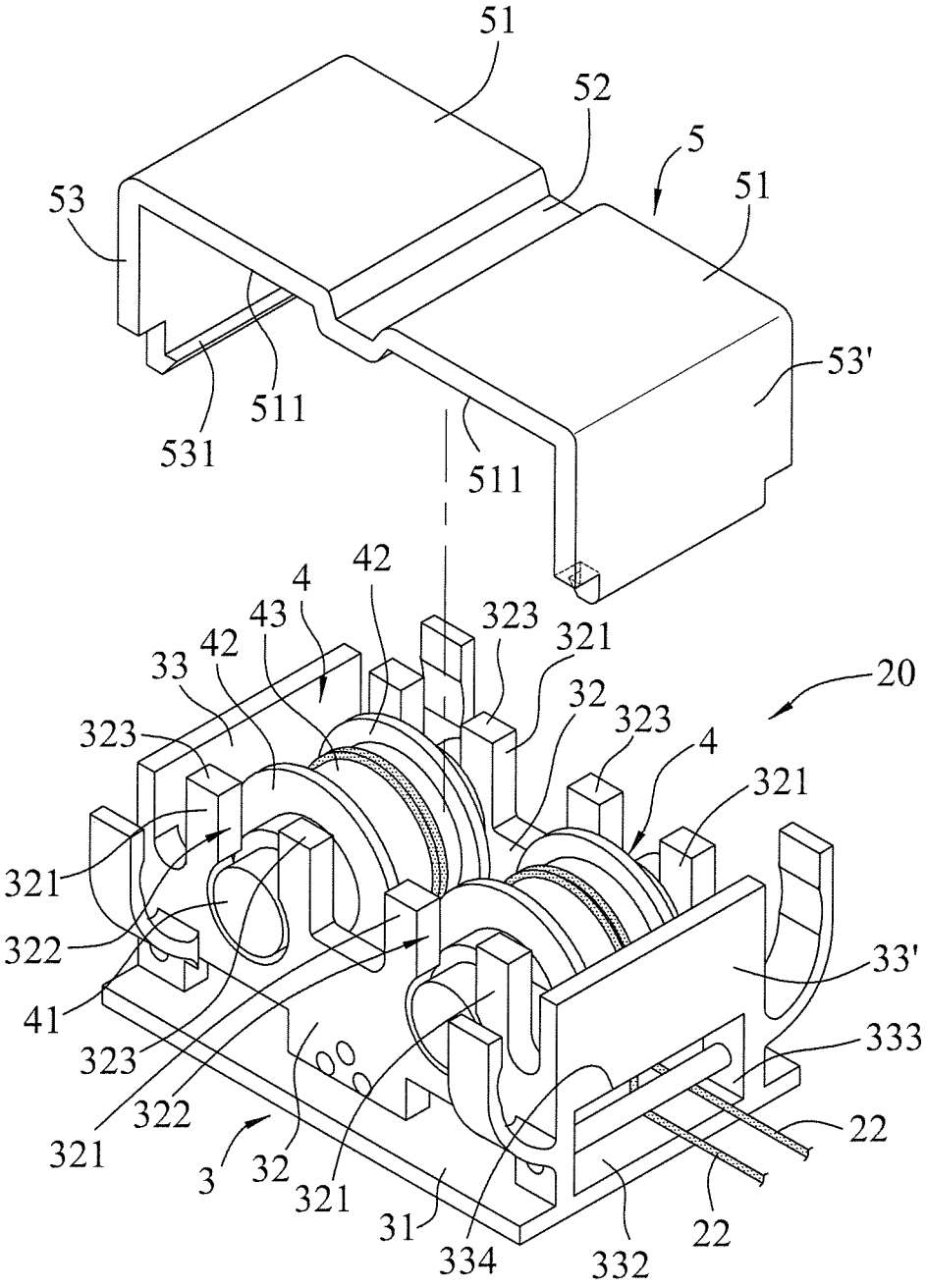
FIG. 2 is a partly exploded perspective view for illustrating the first preferred embodiment of a cord guiding device according to the present invention.
Figure 3:
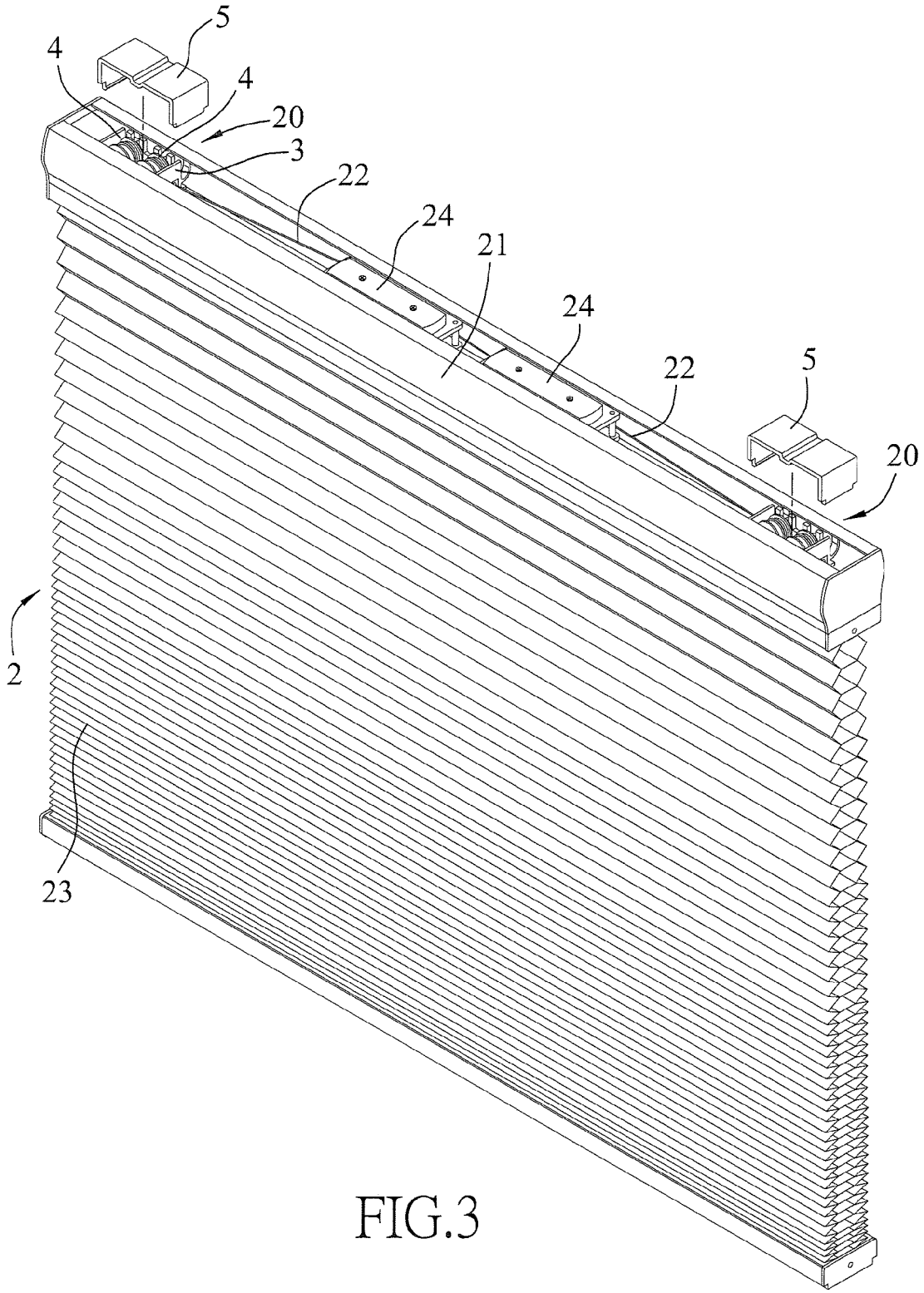
FIG. 3 is a partly exploded perspective view of a window blind assembled with two of the first preferred embodiments.
Figure 4:
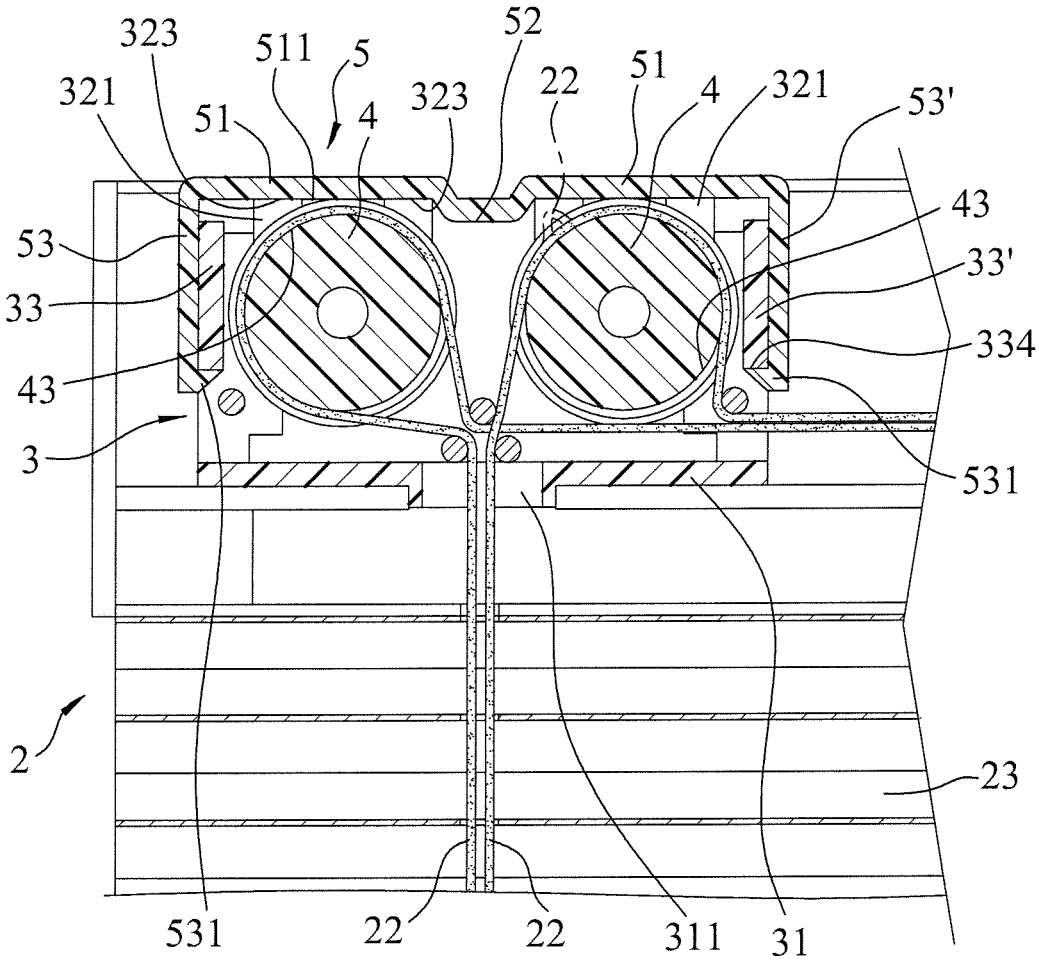
FIG. 4 is a fragmentary schematic cross-sectional view of the window blind.

Referring to FIGS. 2 to 4, the first preferred embodiment of a cord guiding device 20 according to the present invention is adapted to be mounted in an elongated securing seat 21 of a window blind 2. The window blind 2 further includes a plurality of cords 22, a blind 23, and two cord roller devices 24. In this embodiment, two of the cord guiding devices 20 are mounted in the securing seat 21, where each of the cord guiding devices 20 has two respective cords 22 wound thereon. The blind 23 is driven to fold upwardly and unfold downwardly by the cords 22, which are controlled by the cord roller devices 24. Since the process of blind folding and unfolding is well-known, further details will be omitted herein for the sake of brevity.

Each of the cord guiding devices 20 includes a wheel holder 3, two guiding wheels 4, and a cord-blocking unit 5.

The wheel holder 3 includes a base wall 31, two holder walls 32, a first mounting wall 33, and a second mounting wall 33'. The holder walls 32 extend upwardly and respectively from opposite front-rear sides of the base wall 31. The first and second mounting walls 33, 33' extend upwardly and respectively from opposite left-right sides of the base wall 31. The base wall 31 is formed with a through hole 311, and each of the holder walls 32 includes two pairs of (i.e., four) support segments 321 with each pair cooperatively defining a wheel-engaging groove 322 therebetween. Each of the support segments 321 has an end surface 323 opposite to the base wall 31.

The end surfaces 323 of the support segments 321 are of equal heights. In this embodiment, the first and second mounting walls 33, 33' are identical in structure, and each has a groove-defining surface 333 that defines an engaging groove 332 and that has an abutment section 334 opposite to the base wall 31.

Each guiding wheel 4 is rotatably mounted on the wheel holder 3, and, in particular, rotatably received in the wheel-engaging grooves 322 defined by two corresponding opposite pairs of the support segments 321 of the holder walls. Each guiding wheel 4 includes a round axle rod 41 and two protruding flanges 42 spaced apart from each other and radially protruding from the round axle rod 41, and has a wheel surface 43 that is defined and disposed between the protruding flanges 42, and that is adapted for a corresponding one of the cords 22 of the window blind 2 to wind thereon. The first and second mounting wall 33, 33' interpose the guiding wheels 4.

The cord-blocking unit 5 is removably mounted on the wheel holder 3. In this embodiment, the cord-blocking unit 5 is an integrally-formed, one-piece cover and includes two blocking walls 51, an interconnecting wall 52 that interconnects the blocking walls 51 and that protrudes downwardly, and first and second engaging walls 53, 53' that are opposite to each other, that are respectively connected to and respectively and downwardly extending from the blocking walls 51. Each blocking wall 51 is formed with a blocking surface 511 that faces and is disposed proximate to the wheel surface 43 of a corresponding one of the guiding wheels 4 for preventing the cord 22 that is wound on the corresponding guiding wheel 4 from slipping off the wheel surface 43 of the corresponding guiding wheel 4 and out from the protruding flanges 42 of the corresponding guiding wheel 4. The blocking surface 511 abuts against the end surfaces 323 of corresponding support segments 321 of the holder walls 32. In this embodiment, the first and second engaging walls 53, 53' are identical in structure, and each has an engaging hook 531 that abuts against the abutment section 334 of a corresponding one of the first and second mounting walls 33, 33' so as to engage the corresponding one of the first and second mounting walls 33, 33'.

As mentioned above, each of the two cord guiding devices 20 are used with two cords 22.

To assemble the window blind 2, each cord 22 will extend through the positioning hole 311 in the wheel holder 3 of the corresponding cord guiding device 20 after being first wound on the corresponding guiding wheel 4, and will pierce through the blind 23 and engage therewith. Next, the cord-wound guiding wheels 4 are mounted rotatably in the respective wheel-engaging grooves 322. Finally, to couple firmly the cord-blocking unit 5 on the wheel holder 3, the engaging hooks 531 of the first and second engaging walls 53, 53' of the cord-blocking unit 5 are respectively engaged with the first and second mounting walls 33, 33' of the wheel holder 3 with the blocking surfaces 511 of the blocking walls 51 abutting against the end surfaces 323 of the corresponding support segments 321 of the holder walls 32.

Once the cord guiding devices 20 have been assembled to the window blind 2, the blind 23 can upwardly fold and downwardly unfold. When improperly used, the blind 23 will tilt, and a section of the cord 22, which is supposed to be pulled by the cord roller devices 24 to tightly wound on the corresponding guiding wheel 4, will loosen, as exemplarily shown in FIG. 4 in imaginary lines. Because of the presence of the cord-blocking unit 5, whose blocking surface 511 is close enough to the wheel surface 43 of the guiding wheel 4, the loosened section of the cord 22 is prevented from passing over the protruding flanges 42 of the guiding wheel 4 and sliding off from the guiding wheel 4, thereby diminishing the occurrence of jamming of the cord 22.

Figure 5:
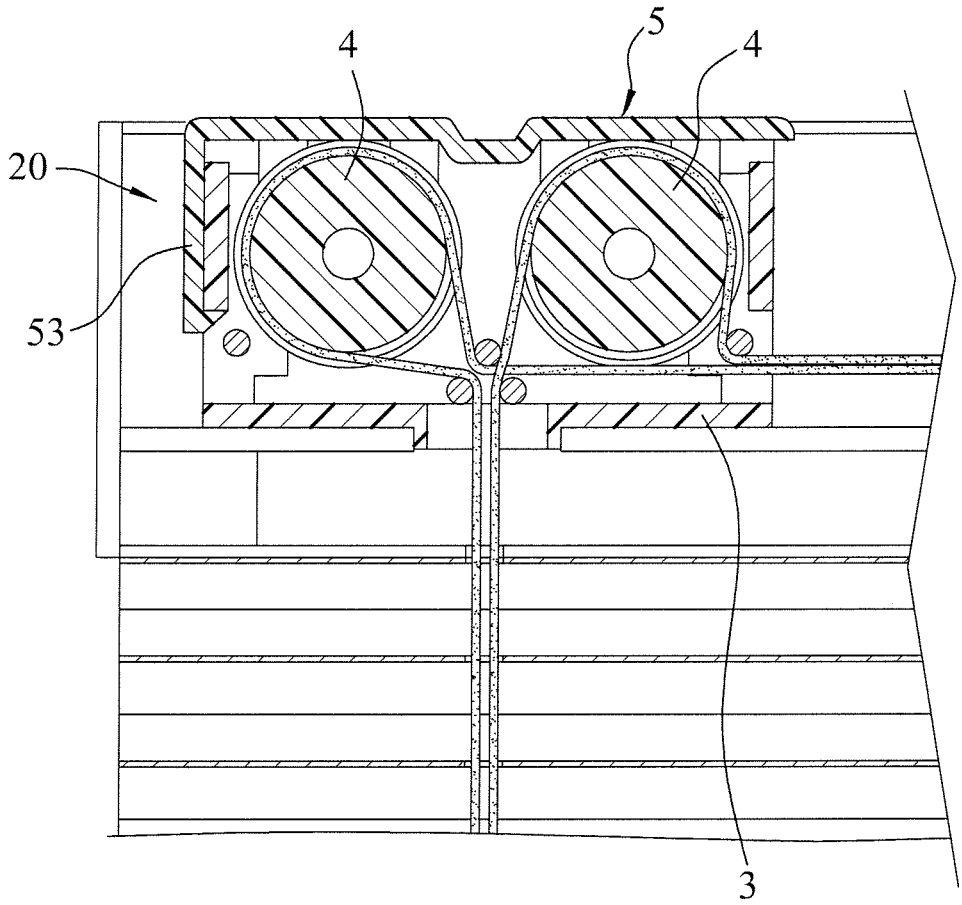
FIG. 5 is a fragmentary schematic cross-sectional view for illustrating a window blind assembled with the second preferred embodiment of a cord guiding device according to the present invention.

With reference to FIG. 5, the second preferred embodiment of the cord guiding device 20 according to the present invention is similar to the first preferred embodiment in structure and differs in the structure of the cord-blocking unit 5. In this embodiment, the second engaging wall 53' (see FIG. 2) is omitted, and with only the first engaging wall 53, the cord-blocking unit 5 can still be engaged with the wheel holder 3.

Figure 6:
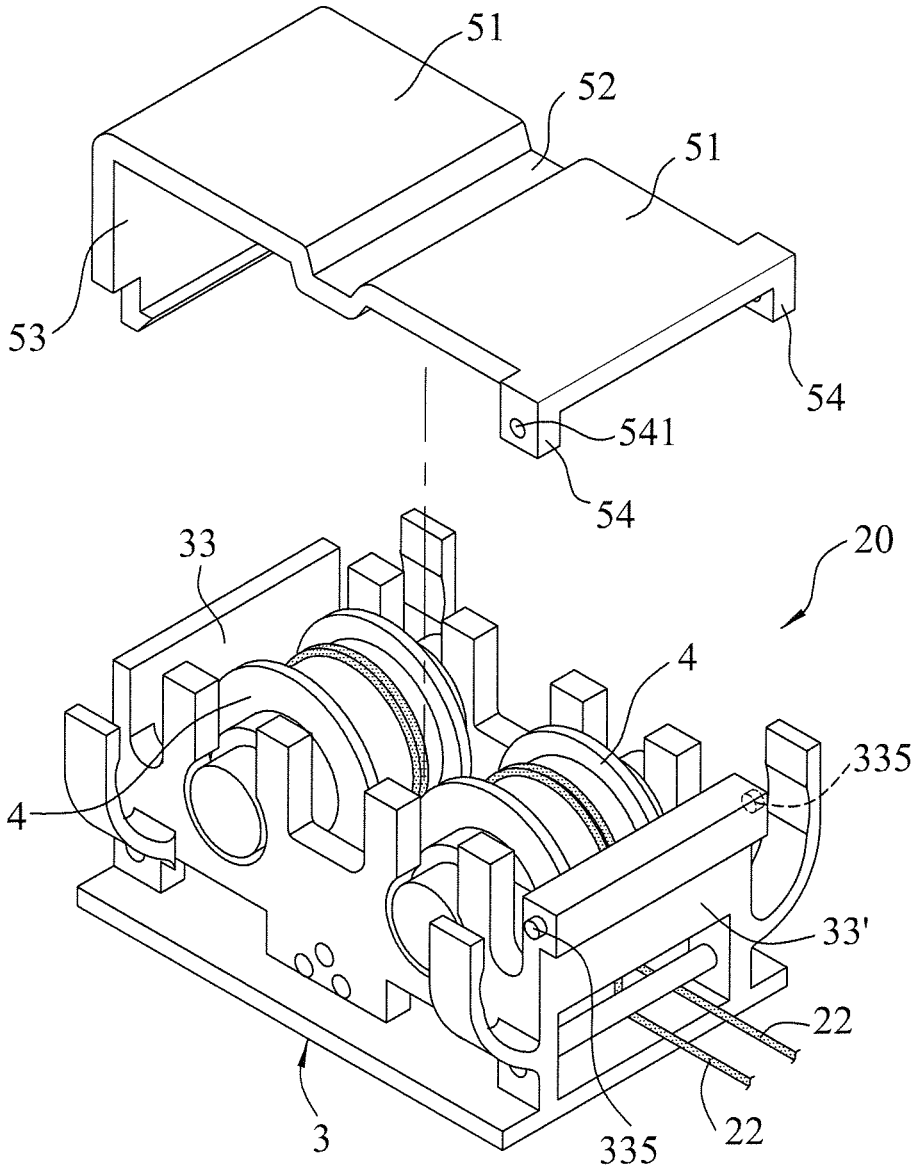
FIG. 6 is a partly exploded perspective view for illustrating the third preferred embodiment of a cord guiding device according to the present invention.
Figure 7:
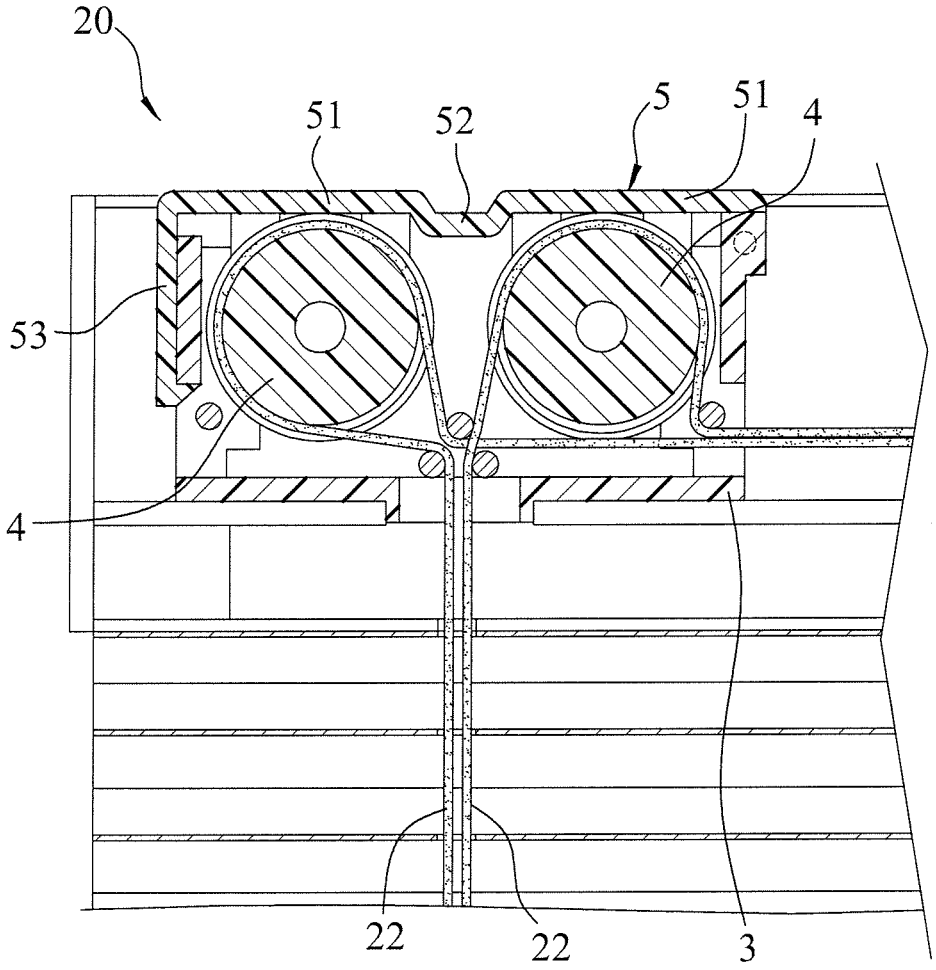
FIG. 7 is a fragmentary schematic cross-sectional view for illustrating a window blind assembled with the third preferred embodiment.

With reference to FIGS. 6 and 7, the third preferred embodiment of the cord guiding device 20 according to the present invention is similar to the first preferred embodiment in structure and differs in that: the cord-blocking unit 5 further includes two pivot portions 54 that are connected to the blocking wall 51 more distant from the first engaging wall 53 at a side opposite to the first engaging wall 53, and the second mounting wall 33' of the wheel holder 3 further includes two pivot-connecting portions 335 pivotally and respectively connected to the pivot portions 54 of the cord-blocking unit 5. In this implementation, each of the pivot portions 54 is formed with a pivot hole 541, and each of the pivot-connecting portions 335 is in the form of a protrusion.

Figure 8:
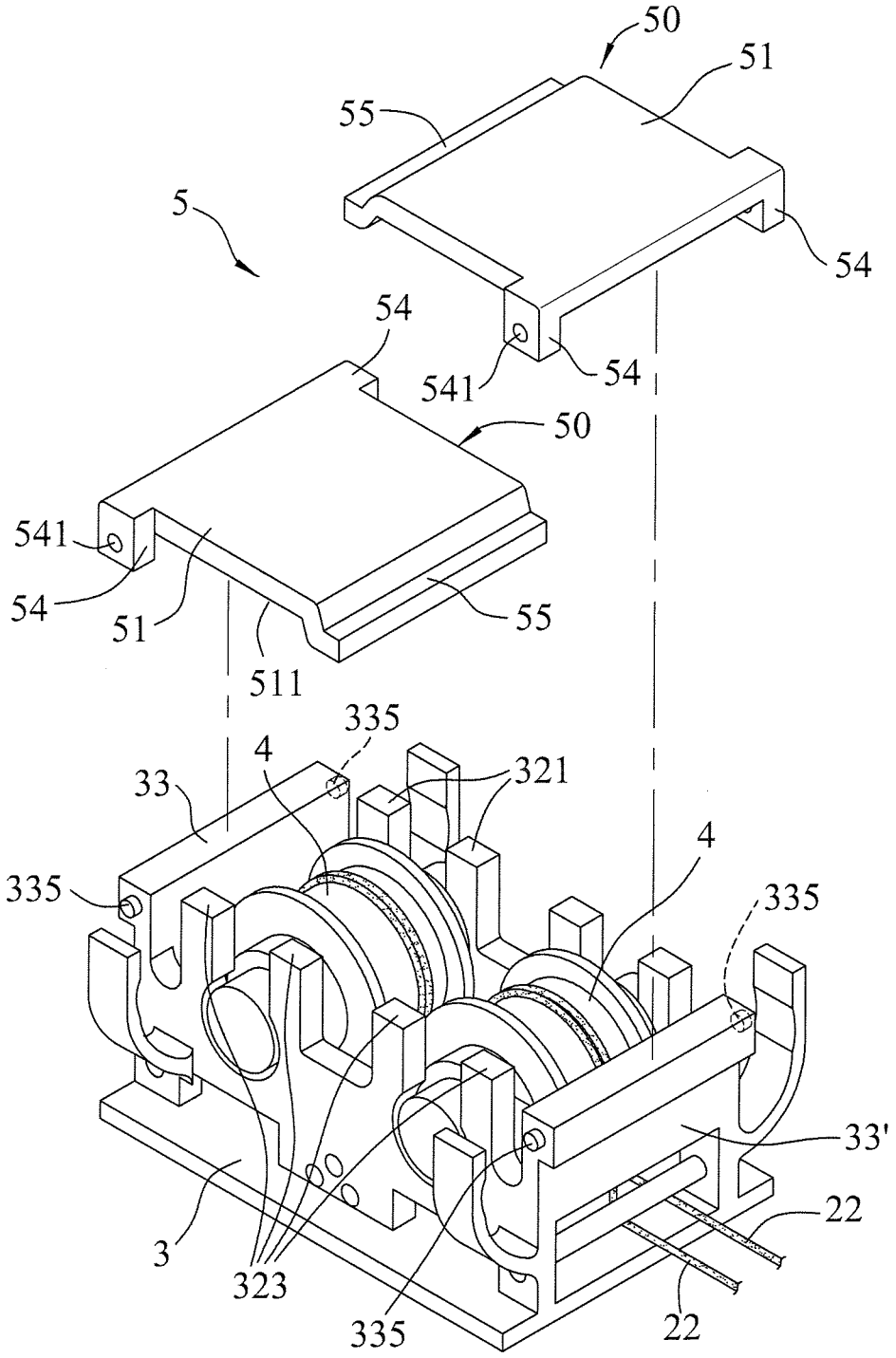
FIG. 8 is a partly exploded perspective view for illustrating the fourth preferred embodiment of a cord guiding device according to the present invention.
Figure 9:
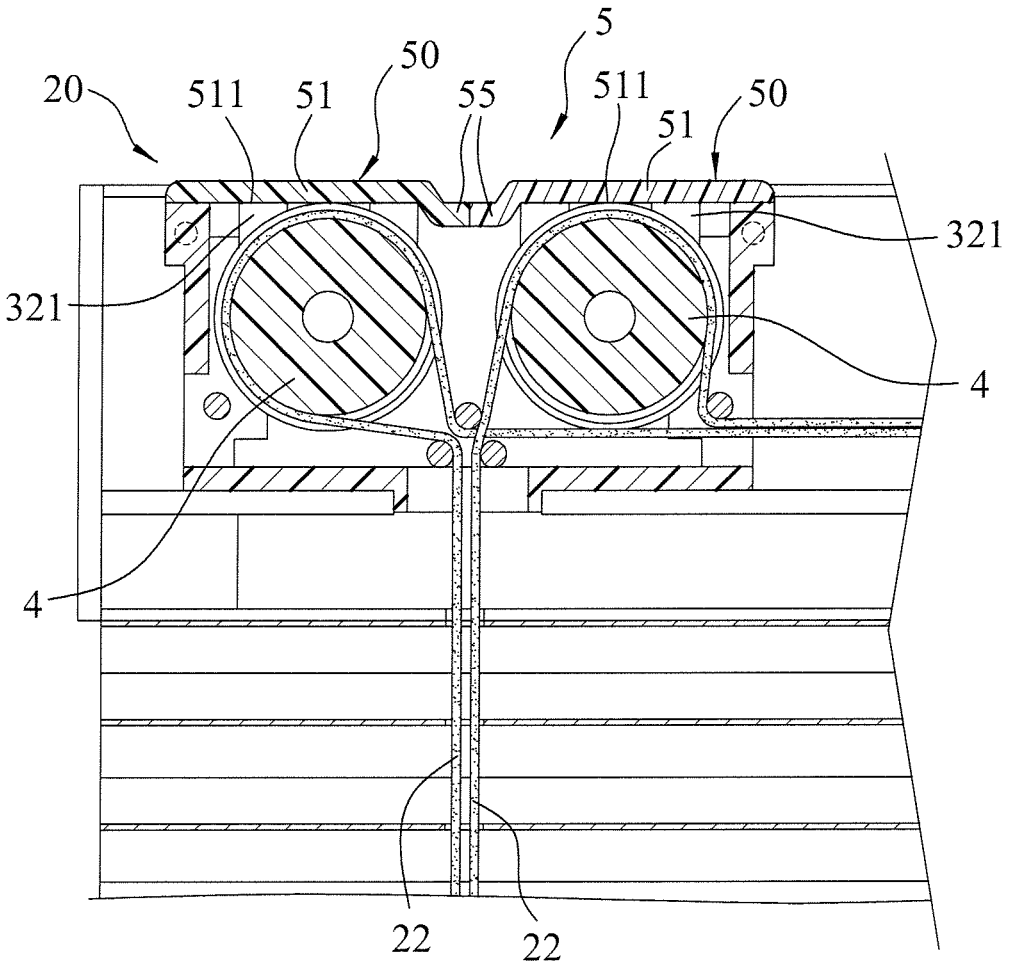
FIG. 9 is a fragmentary schematic cross-sectional view for illustrating a window blind assembled with the fourth preferred embodiment.

With reference to FIGS. 8 and 9, the fourth preferred embodiment of the cord guiding device 20 according to the present invention is similar to the first preferred embodiment in structure and differs in that: the cord-blocking unit 5 includes two covers 50, respectively including the two blocking wall 51 and respectively connected pivotally to the first and second mounting walls 33, 33' of the wheel holder 3. Specifically, each cover 50 further includes an end wall 55 connected to and extending downwardly from one side of the blocking wall 51, and two pivot portions 54 connected to another side of the blocking wall 51 opposite to the end wall 55. Each of the first and second mounting walls 33, 33' of the wheel holder 3 further includes two pivot-connecting portions 335 pivotally and respectively connected to the pivot portions 54 of the covers 50. In this implementation, each of the pivot portions 54 is formed with a pivot hole 541, and each of the pivot-connecting portions 335 is in the form of a protrusion. The end walls 55 contact each other when the covers 50 are pivoted downward such that the blocking surfaces 511 of the blocking walls 51 respectively abut against the end surfaces 323 of the support segments 321.

Figure 10:
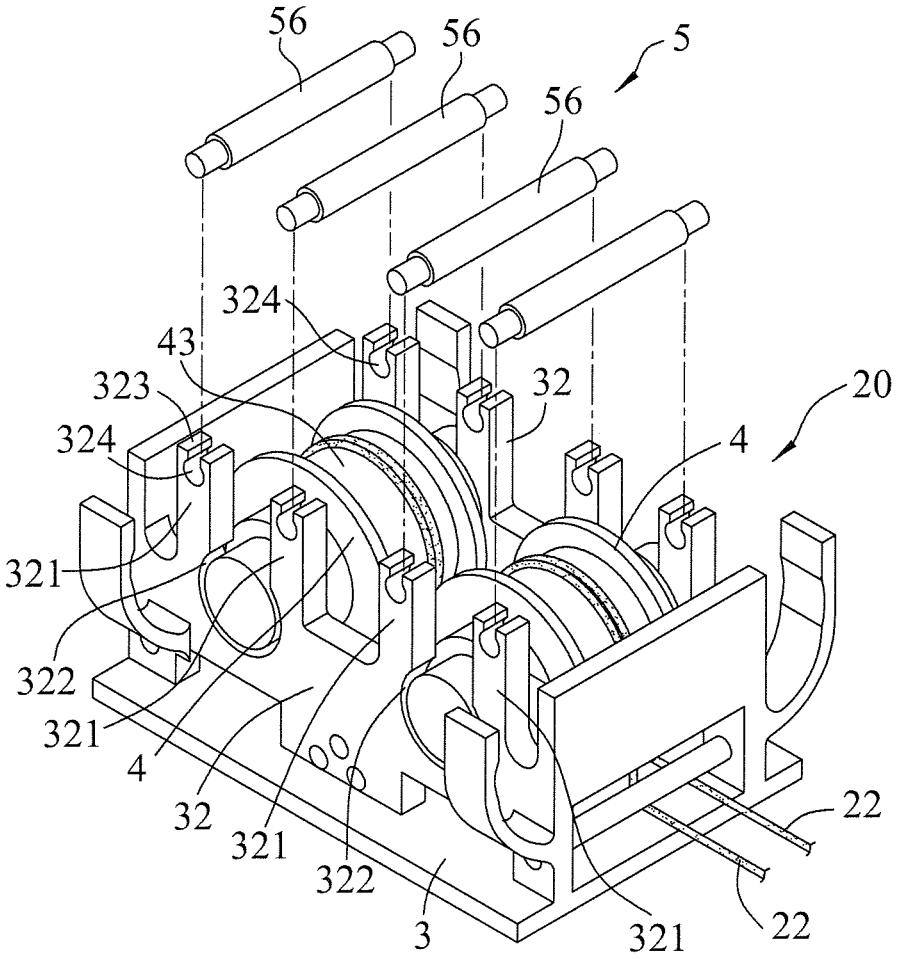
FIG. 10 is a partly exploded perspective view for illustrating the fifth preferred embodiment of a cord guiding device according to the present invention.
Figure 11:
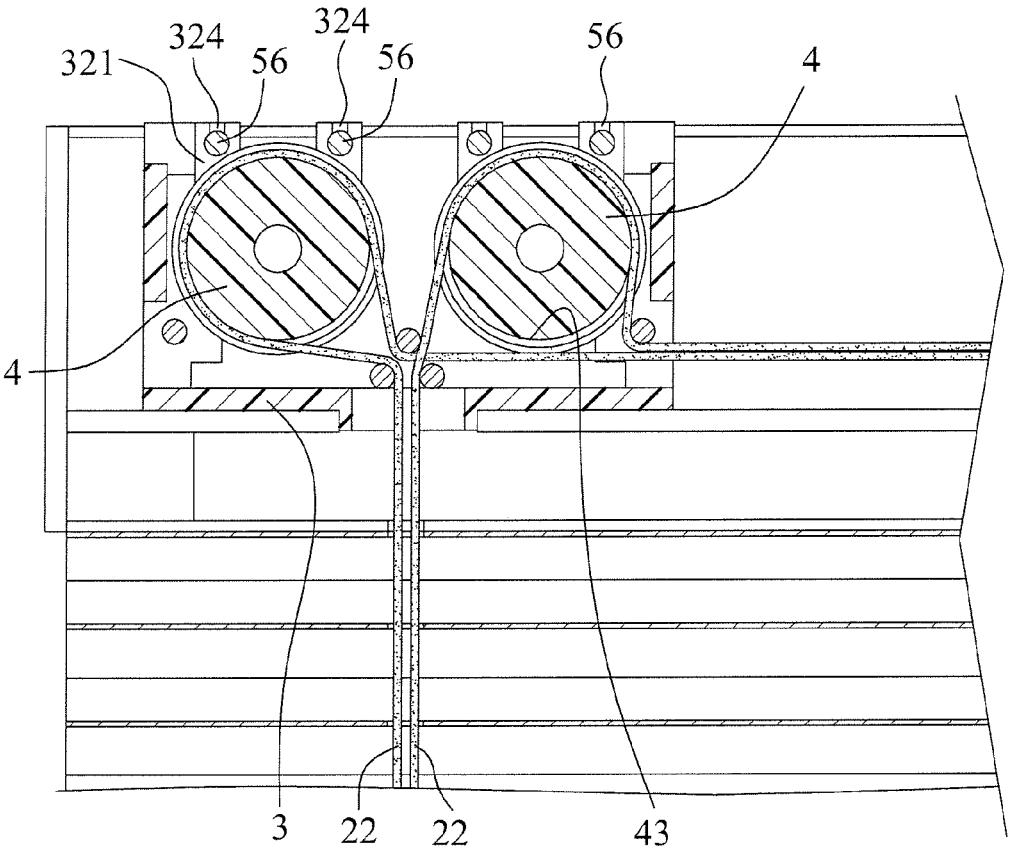
FIG. 11 is a fragmentary schematic cross-sectional view for illustrating a window blind assembled with the fifth preferred embodiment.

Referring to FIGS. 10 and 11, the fifth preferred embodiment of the cord guiding device 20 according to the present invention differs from the previous embodiments mainly in the cord-blocking unit 5, and also in that the top abutting surface 323 of each of the support segments 321 is formed with a rod-engaging groove 324. Specifically, the cord-blocking unit 5 includes a plurality of blocking rods 56, each of which is supported and rotatably received in a corresponding opposite front-rear pair of the rod-engaging grooves 324 in the support segments 321. Portions of the outer surfaces of the blocking rods 56 that face the wheel surfaces 43 of the guiding wheels 4 serve as the blocking surfaces mentioned in the previous disclosure. Herein, the number of blocking rods 56 is four.

Figure 12:
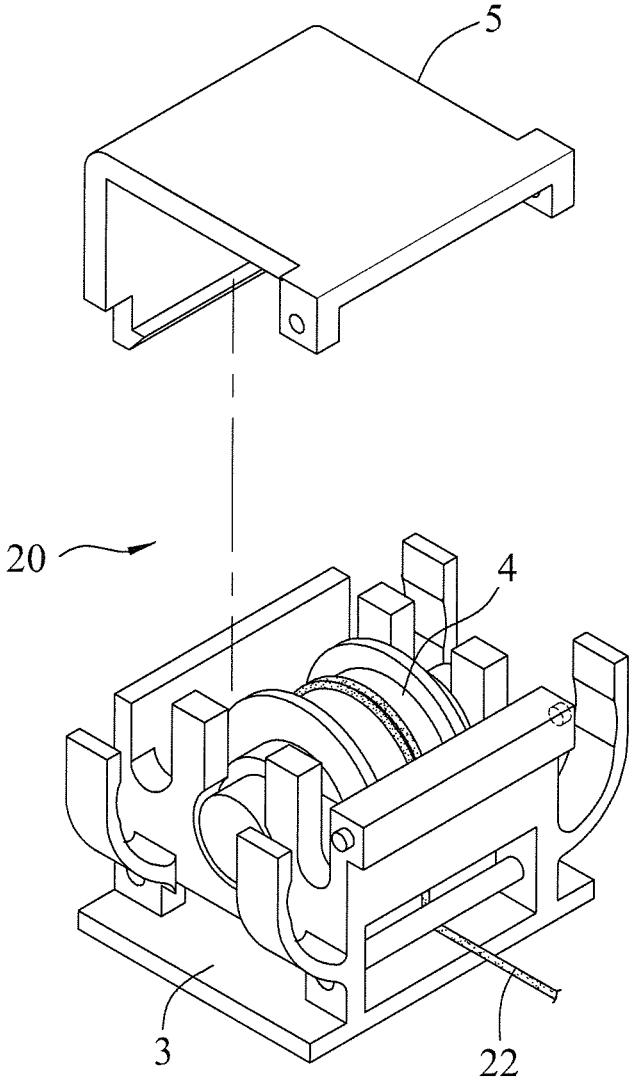
FIG. 12 is a partly exploded perspective view for illustrating the sixth preferred embodiment of a cord guiding device according to the present invention.

Referring to FIG. 12, the sixth preferred embodiment of the cord guiding device 20 according to the present invention is similar to the second preferred embodiment in structure, but includes only a single guiding wheel 4 to demonstrate an exemplary structure suitable for use with a single cord 22.

In conclusion, the cord guiding device 20 of the present invention not only guides the cord 22, but with the provision of the cord-blocking unit 5, also prevents the cord 22 from sliding off from the guiding wheel 4 when loosened, thereby ensuring the smooth control of the cord 22.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A cord guiding device for a window blind, comprising:

a wheel holder;

at least one guiding wheel rotatably mounted on said wheel holder, including a round axle rod and two protruding flanges that are spaced apart from each other and radially protrude from said axle rod, and having a wheel surface that is defined and disposed between said protruding flanges and that is adapted for at least one cord of the window blind to wind thereon; and a cord-blocking unit mounted on said wheel holder, and having at least one blocking surface that faces and is disposed proximate to said wheel surface of said at least one guiding wheel for preventing the cord from slipping off said wheel surface and out from said protruding flanges of said at least one guiding wheel;

wherein said wheel holder includes a base wall and two holder walls extending upward from opposite sides of said base wall, each of said holder walls including two support segments, which define a wheel-engaging groove therebetween, and each of which is formed with a rod-engaging groove, said cord-blocking unit including two blocking rods, each of which has two round opposite ends that are rotatably supported in a corresponding opposite pair of said rod-engaging grooves in said support segments of said holder walls, portions of outer surfaces of said blocking rods that face said wheel surface serving as said blocking surface;

said wheel-engaging groove having a substantially circular first receiving portion and a first constricted portion connected to said first receiving portion, said first constricted portion serving as an entrance to said wheel-engaging groove and having a maximum width that is smaller than that of said first receiving portion; and, each of said rod-engaging grooves having a substantially circular second receiving portion and a second constricted portion connected to said second receiving portion, said second constricted portion serving as an entrance to said rod-engaging groove and having a maximum width that is smaller than that of said second receiving portion.

2. The cord guiding device as claimed in claim 1, comprising two of said guiding wheels that are respectively adapted for two cords of the window blind to wind thereon, each of said holder walls of said wheel holder including four of said support segments, said cord-blocking unit including four of said blocking rods.

* * * * *